US009883318B2

(12) United States Patent
Bongiovi et al.

(10) Patent No.: US 9,883,318 B2
(45) **Date of Patent: *Jan. 30, 2018**

(54) SYSTEM AND METHOD FOR STEREO FIELD ENHANCEMENT IN TWO-CHANNEL AUDIO SYSTEMS

(71) Applicant: Bongiovi Acoustics LLC, Port St. Lucie, FL (US)

(72) Inventors: Anthony Bongiovi, Port St. Lucie, FL (US); Glenn Zelniker, Gainesville, FL (US); Joseph G. Butera, Stuart, FL (US)

(73) Assignee: Bongiovi Acoustics LLC, Port St. Lucie, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/213,741

(22) Filed: Jul. 19, 2016

(65) Prior Publication Data

US 2017/0041732 A1 Feb. 9, 2017

Related U.S. Application Data

(63) Continuation-in-part of application No. 13/936,252, filed on Jul. 8, 2013, now Pat. No. 9,398,394.

(Continued)

(51) Int. Cl.
*H04S 7/00* (2006.01)
*H04S 1/00* (2006.01)

(52) U.S. Cl.
CPC ..... *H04S 7/307* (2013.01); *H04S 1/007* (2013.01); *H04S 2400/05* (2013.01); *H04S 2400/13* (2013.01); *H04S 2420/07* (2013.01)

(58) Field of Classification Search
CPC . H04S 7/307; H04S 1/002; H04S 5/00; H04S 3/00; H04S 2420/01; H04S 1/005
See application file for complete search history.

(56) References Cited

U.S. PATENT DOCUMENTS 3,430,007 A 2/1969 Thielsen
3,795,876 A 3/1974 Takashi et al.
(Continued)

FOREIGN PATENT DOCUMENTS

AU 2005274099 10/2010
AU 20070325096 4/2012
(Continued)

OTHER PUBLICATIONS

NovaSound Int., http://www.novasoundint.com/new_page_t.htm, 2004.

(Continued)

*Primary Examiner* — Brenda Bernardi
(74) *Attorney, Agent, or Firm* — Malloy & Malloy, P.L.

(57) ABSTRACT

The present invention provides methods and systems for digitally processing audio signals in two-channel audio systems and/or applications. In particular, the present invention includes a first filter structured to split a two-channel audio input signal into a low frequency signal and a higher frequency signal. A M/S splitter is then structured to split the higher frequency signal into a middle and a side signal. A detection module is then configured to create a detection signal from the middle signal, which is used in a compression module configured to modulate the side signal to create a gain-modulated side signal. A processing module is then structured to combine the low frequency signal, middle signal, and the gain-modulated side signal to form a final output signal.

28 Claims, 5 Drawing Sheets

Related U.S. Application Data

(60) Provisional application No. 61/834,063, filed on Jun. 12, 2013.

(56) References Cited

U.S. PATENT DOCUMENTS 3,813,687 A 5/1974 Geil
4,162,462 A 7/1979 Endoh et al.
4,184,047 A 1/1980 Langford
4,218,950 A 8/1980 Uetrecht
4,226,533 A 10/1980 Snowman
4,257,325 A 3/1981 Bertagni
4,353,035 A 10/1982 Schröder
4,356,558 A 10/1982 Owen et al.
4,363,007 A 12/1982 Haramoto et al.
4,399,474 A 8/1983 Coleman, Jr.
4,412,100 A 10/1983 Orban
4,458,362 A 7/1984 Berkovitz et al.
4,517,415 A 5/1985 Laurence
4,538,297 A 8/1985 Waller
4,549,289 A 10/1985 Schwartz et al.
4,584,700 A 4/1986 Scholz
4,602,381 A * 7/1986 Cugnini ..... H04H 20/48 333/14
4,612,665 A 9/1986 Inami et al.
4,641,361 A 2/1987 Rosback
4,677,645 A 6/1987 Kaniwa et al.
4,696,044 A 9/1987 Waller, Jr.
4,701,953 A 10/1987 White
4,704,726 A 11/1987 Gibson
4,715,559 A 12/1987 Fuller
4,739,514 A 4/1988 Short et al.
4,815,142 A 3/1989 Imreh
4,856,068 A 8/1989 Quatieri, Jr. et al.
4,887,299 A 12/1989 Cummins et al.
4,997,058 A 3/1991 Bertagni
5,007,707 A 4/1991 Bertagni
5,073,936 A 12/1991 Gurike et al.
5,133,015 A 7/1992 Scholz
5,195,141 A 3/1993 Jang
5,210,806 A 5/1993 Kihara et al.
5,239,997 A 8/1993 Guarino et al.
5,355,417 A 10/1994 Burdisso et al.
5,361,381 A 11/1994 Short
5,384,856 A 1/1995 Kyouno et al.
5,420,929 A 5/1995 Geddes et al.
5,425,107 A 6/1995 Bertagni et al.
5,463,695 A 10/1995 Werrbach
5,465,421 A 11/1995 McCormick et al.
5,467,775 A 11/1995 Callahan et al.
5,473,214 A 12/1995 Hildebrand
5,515,444 A 5/1996 Burdisso et al.
5,539,835 A 7/1996 Bertagni et al.
5,541,866 A 7/1996 Sato et al.
5,572,443 A 11/1996 Emoto et al.
5,615,275 A 3/1997 Bertagni
5,617,480 A 4/1997 Ballard et al.
5,638,456 A 6/1997 Conley et al.
5,640,685 A 6/1997 Komoda
5,671,287 A 9/1997 Gerzon
5,693,917 A 12/1997 Bertagni et al.
5,699,438 A 12/1997 Smith et al.
5,727,074 A 3/1998 Hildebrand
5,737,432 A 4/1998 Werrbach
5,828,768 A 10/1998 Eatwell et al.
5,832,097 A 11/1998 Armstrong et al.
5,838,805 A 11/1998 Warnaka et al.
5,848,164 A 12/1998 Levine
5,861,686 A 1/1999 Lee
5,872,852 A 2/1999 Dougherty
5,901,231 A 5/1999 Parrella et al.
5,990,955 A 11/1999 Koz
6,002,777 A 12/1999 Grasfield
6,058,196 A 5/2000 Heron
6,078,670 A 6/2000 Beyer
6,093,144 A 7/2000 Jaeger et al.
6,108,431 A 8/2000 Bachler
6,195,438 B1 2/2001 Yumoto et al.
6,201,873 B1 3/2001 Dal Farra
6,202,601 B1 3/2001 Ouellette et al.
6,208,237 B1 3/2001 Saiki et al.
6,263,354 B1 7/2001 Gandhi
6,285,767 B1 9/2001 Klayman
6,292,511 B1 9/2001 Goldston et al.
6,317,117 B1 11/2001 Goff
6,318,797 B1 11/2001 Böhm et al.
6,332,029 B1 12/2001 Azima et al.
6,343,127 B1 1/2002 Billoud
6,518,852 B1 2/2003 Derrick
6,529,611 B2 3/2003 Kobayashi et al.
6,535,846 B1 3/2003 Shashoua
6,570,993 B1 5/2003 Fukuyama
6,587,564 B1 7/2003 Cusson
6,618,487 B1 9/2003 Azima et al.
6,661,897 B2 12/2003 Smith
6,661,900 B1 12/2003 Allred et al.
6,772,114 B1 8/2004 Sluijter et al.
6,847,258 B2 1/2005 Ishida et al.
6,871,525 B2 3/2005 Withnall et al.
6,907,391 B2 6/2005 Bellora et al.
6,999,826 B1 2/2006 Zhou et al.
7,006,653 B2 2/2006 Guenther
7,016,746 B2 3/2006 Wiser et al.
7,024,001 B1 4/2006 Nakada
7,058,463 B1 6/2006 Ruha et al.
7,123,728 B2 10/2006 King et al.
7,254,243 B2 8/2007 Bongiovi
7,266,205 B2 9/2007 Miller
7,274,795 B2 9/2007 Bongiovi
7,519,189 B2 4/2009 Bongiovi
7,577,263 B2 8/2009 Tourwe
7,613,314 B2 11/2009 Camp, Jr.
7,676,048 B2 3/2010 Tsutsui
7,711,442 B2 5/2010 Ryle et al.
7,747,447 B2 6/2010 Christensen et al.
7,764,802 B2 7/2010 Oliver
7,778,718 B2 8/2010 Janke et al.
7,916,876 B1 3/2011 Helsloot
8,068,621 B2 11/2011 Okabayashi et al.
8,144,902 B2 * 3/2012 Johnston ..... H04S 1/007 381/310
8,160,274 B2 4/2012 Bongiovi
8,175,287 B2 5/2012 Ueno et al.
8,218,789 B2 7/2012 Bharitkar et al.
8,229,136 B2 7/2012 Bongiovi
8,284,955 B2 10/2012 Bongiovi et al.
8,385,864 B2 2/2013 Dickson et al.
8,462,963 B2 6/2013 Bongiovi
8,472,642 B2 6/2013 Bongiovi
8,503,701 B2 8/2013 Miles et al.
8,565,449 B2 10/2013 Bongiovi
8,619,998 B2 * 12/2013 Walsh ..... H04S 3/02 381/1
8,705,765 B2 4/2014 Bongiovi
8,750,538 B2 6/2014 Avendano et al.
8,811,630 B2 8/2014 Burlingame
8,879,743 B1 11/2014 Mitra
9,195,433 B2 11/2015 Bongiovi et al.
9,264,004 B2 2/2016 Bongiovi et al.
9,276,542 B2 3/2016 Bongiovi et al.
9,281,794 B1 3/2016 Bongiovi et al.
9,344,828 B2 5/2016 Bongiovi et al.
9,348,904 B2 5/2016 Bongiovi et al.
9,350,309 B2 5/2016 Bongiovi et al.
9,397,629 B2 7/2016 Bongiovi et al.
9,398,394 B2 7/2016 Bongiovi et al.
9,413,321 B2 8/2016 Bongiovi et al.
9,564,146 B2 2/2017 Bongiovi et al.
9,615,189 B2 4/2017 Copt et al.
9,615,813 B2 4/2017 Copt et al.
9,621,994 B1 4/2017 Bongiovi et al.
9,638,672 B2 5/2017 Butera, III et al.
9,741,355 B2 8/2017 Bongiovi et al.
9,793,872 B2 10/2017 Bongiovi et al.

(56) References Cited

U.S. PATENT DOCUMENTS

2001/0008535 A1 7/2001 Lanigan
2001/0043704 A1 11/2001 Schwartz
2002/0057808 A1 5/2002 Goldstein
2002/0094096 A1 7/2002 Paritsky et al.
2003/0016838 A1 1/2003 Paritsky et al.
2003/0023429 A1 1/2003 Claesson
2003/0035555 A1 2/2003 King et al.
2003/0043940 A1 3/2003 Janky et al.
2003/0112088 A1 6/2003 Bizjak
2003/0138117 A1 7/2003 Goff
2003/0142841 A1 7/2003 Wiegand
2003/0164546 A1 9/2003 Giger
2003/0179891 A1 9/2003 Rabinowitz et al.
2003/0216907 A1 11/2003 Thomas
2004/0003805 A1 1/2004 Ono et al.
2004/0022400 A1 2/2004 Magrath
2004/0044804 A1 3/2004 MacFarlane
2004/0086144 A1 5/2004 Kallen
2004/0103588 A1 6/2004 Allaei
2004/0138769 A1 7/2004 Akiho
2004/0146170 A1 7/2004 Zint
2004/0189264 A1 9/2004 Matsuura et al.
2005/0090295 A1 4/2005 Ali et al.
2005/0117771 A1 6/2005 Vosburgh et al.
2005/0129248 A1* 6/2005 Kraemer ..... H04S 1/002 381/11
2005/0175185 A1 8/2005 Korner
2005/0201572 A1 9/2005 Lindahl et al.
2005/0249272 A1 11/2005 Kirkeby et al.
2005/0254564 A1 11/2005 Tsutsui
2006/0034467 A1 2/2006 Sleboda et al.
2006/0064301 A1 3/2006 Aguilar et al.
2006/0098827 A1 5/2006 Paddock et al.
2006/0115107 A1 6/2006 Vincent et al.
2006/0126851 A1* 6/2006 Yuen ..... H04S 1/005 381/1
2006/0126865 A1 6/2006 Blamey et al.
2006/0138285 A1 6/2006 Oleski et al.
2006/0140319 A1 6/2006 Eldredge et al.
2006/0153281 A1 7/2006 Karlsson
2006/0189841 A1 8/2006 Pluvinage
2006/0285696 A1 12/2006 Houtsma
2006/0291670 A1 12/2006 King et al.
2007/0010132 A1 1/2007 Nelson
2007/0030994 A1 2/2007 Ando et al.
2007/0119421 A1 5/2007 Lewis et al.
2007/0165872 A1 7/2007 Bridger et al.
2007/0173990 A1 7/2007 Smith et al.
2007/0177459 A1 8/2007 Behn
2007/0206643 A1 9/2007 Egan
2007/0223713 A1 9/2007 Gunness
2007/0223717 A1 9/2007 Boersma
2007/0253577 A1 11/2007 Yen et al.
2008/0031462 A1 2/2008 Walsh et al.
2008/0040116 A1 2/2008 Cronin
2008/0069385 A1 3/2008 Revit
2008/0093157 A1 4/2008 Drummond et al.
2008/0112576 A1 5/2008 Bongiovi
2008/0123870 A1 5/2008 Stark
2008/0123873 A1 5/2008 Bjorn-Josefsen et al.
2008/0137876 A1 6/2008 Kassal et al.
2008/0137881 A1 6/2008 Bongiovi
2008/0165989 A1* 7/2008 Seil ..... H04H 60/04 381/119
2008/0181424 A1 7/2008 Schulein et al.
2008/0212798 A1 9/2008 Zartarian
2008/0219459 A1 9/2008 Bongiovi et al.
2008/0255855 A1 10/2008 Lee et al.
2009/0022328 A1* 1/2009 Neugebauer ..... H04S 7/30 381/27
2009/0054109 A1 2/2009 Hunt
2009/0062946 A1 3/2009 Bongiovi et al.
2009/0086996 A1 4/2009 Bongiovi et al.
2009/0211838 A1 8/2009 Bilan
2009/0282810 A1 11/2009 Leone et al.
2009/0290725 A1 11/2009 Huang
2009/0296959 A1 12/2009 Bongiovi
2010/0166222 A1 7/2010 Bongiovi
2010/0256843 A1 10/2010 Bergstein et al.
2010/0278364 A1 11/2010 Berg
2010/0303278 A1 12/2010 Sahyoun
2011/0013736 A1 1/2011 Tsukamoto et al.
2011/0087346 A1 4/2011 Larsen et al.
2011/0096936 A1 4/2011 Gass
2011/0194712 A1* 8/2011 Potard ..... H04S 1/002 381/300
2011/0230137 A1 9/2011 Hicks et al.
2011/0257833 A1 10/2011 Trush et al.
2012/0014553 A1 1/2012 Bonanno
2012/0099741 A1 4/2012 Gotoh et al.
2012/0170759 A1* 7/2012 Yuen ..... H04S 3/002 381/17
2012/0189131 A1 7/2012 Ueno et al.
2012/0213034 A1 8/2012 Imran
2012/0213375 A1 8/2012 Mahabub et al.
2012/0302920 A1 11/2012 Bridger et al.
2013/0083958 A1 4/2013 Katz et al.
2013/0121507 A1 5/2013 Bongiovi et al.
2013/0162908 A1 6/2013 Son et al.
2013/0163783 A1 6/2013 Burlingame
2013/0169779 A1 7/2013 Pedersen
2013/0220274 A1 8/2013 Deshpande et al.
2013/0227631 A1 8/2013 Sharma et al.
2013/0242191 A1 9/2013 Leyendecker
2013/0288596 A1 10/2013 Suzuki et al.
2013/0338504 A1 12/2013 Demos et al.
2014/0067236 A1 3/2014 Henry et al.
2014/0100682 A1 4/2014 Bongiovi
2014/0112497 A1 4/2014 Bongiovi
2014/0153730 A1 6/2014 Habboushe et al.
2014/0153765 A1 6/2014 Gan et al.
2014/0185829 A1 7/2014 Bongiovi
2014/0261301 A1 9/2014 Leone
2014/0369504 A1 12/2014 Bongiovi
2014/0369521 A1 12/2014 Bongiovi et al.
2014/0379355 A1 12/2014 Hosokawsa
2015/0215720 A1 7/2015 Carroll
2015/0297169 A1 10/2015 Copt et al.
2015/0297170 A1 10/2015 Copt et al.
2016/0036402 A1 2/2016 Bongiovi et al.
2016/0044436 A1 2/2016 Copt et al.
2016/0240208 A1 8/2016 Bongiovi et al.
2016/0258907 A1 9/2016 Butera, III et al.
2016/0344361 A1 11/2016 Bongiovi et al.
2017/0033755 A1 2/2017 Bongiovi et al.
2017/0041732 A1 2/2017 Bongiovi et al.
2017/0272887 A1 9/2017 Copt et al.
2017/0289695 A1 10/2017 Bongiovi et al.

FOREIGN PATENT DOCUMENTS

AU 2012202127 7/2014
BR 96114177 2/1999
BR 96113723 7/1999
CA 2533221 6/1995
CA 2161412 4/2000
CA 2576829 7/2014
CA 2670973 9/2017
CA 2785743 9/2017
CN 1173268 2/1998
CN 1173268 A 2/1998
CN 1221528 6/1999
CN 1221528 A 6/1999
CN 1910816 2/2007
CN 1910816 A 2/2007
CN 101536541 9/2009
CN 101536541 A 9/2009
CN 10166526 1/2011
CN 101946526 A 1/2011
CN 102265641 11/2011
CN 102652337 8/2012
CN 103004237 3/2013
CN 103004237 A 3/2013
CN 0780050323 5/2013

(56) References Cited

FOREIGN PATENT DOCUMENTS

| | | | |
|---|---|---|---|
| CN | 203057339 | | 7/2013 |
| EP | 0206746 | B1 | 8/1992 |
| EP | 0541646 | | 1/1995 |
| EP | 0580579 | | 6/1998 |
| EP | 0698298 | | 2/2000 |
| EP | 0932523 | | 6/2000 |
| EP | 0666012 | | 11/2002 |
| EP | 2814267 | B1 | 10/2016 |
| ES | 2218599 | | 10/1998 |
| ES | 2249788 | | 10/1998 |
| ES | 2219949 | | 8/1999 |
| GB | 2003707 | A | 3/1979 |
| GB | 2320393 | | 12/1996 |
| ID | P0031074 | | 6/2012 |
| IN | 260362 | | 4/2014 |
| IS | 198914 | | 7/2014 |
| JP | 3150910 | | 6/1991 |
| JP | 7106876 | | 4/1995 |
| JP | 2005500768 | | 1/2005 |
| JP | 4787255 | | 7/2011 |
| JP | 5048782 | | 7/2012 |
| JP | 201543561 | | 3/2015 |
| KR | 1020040022442 | | 3/2004 |
| KR | 1020090101209 | | 9/2009 |
| KR | 101503541 | | 3/2015 |
| MO | J001182 | | 10/2013 |
| MX | 274143 | | 8/2005 |
| MX | 301172 | | 11/2006 |
| MX | 315197 | | 11/2013 |
| NO | 340702 | | 6/2017 |
| NZ | 553744 | | 1/2009 |
| NZ | 574141 | | 4/2010 |
| NZ | 557201 | | 5/2012 |
| PH | 12009501073 | | 11/2014 |
| RU | 2407142 | | 12/2010 |
| RU | 2483363 | | 5/2013 |
| SG | 152762 | | 12/2011 |
| SG | 155213 | | 2/2013 |
| SU | 1319288 | | 6/1987 |
| WO | WO 9219080 | | 10/1992 |
| WO | WO 9311637 | | 6/1993 |
| WO | WO 9321743 | | 10/1993 |
| WO | WO 9427331 | | 11/1994 |
| WO | WO 9514296 | | 5/1995 |
| WO | WO 9531805 | | 11/1995 |
| WO | WO 9535628 | | 12/1995 |
| WO | WO 9601547 | | 1/1996 |
| WO | WO 9611465 | | 4/1996 |
| WO | WO 9708847 | | 3/1997 |
| WO | WO 9709698 | | 3/1997 |
| WO | WO 9709840 | | 3/1997 |
| WO | WO 9709841 | | 3/1997 |
| WO | WO 9709842 | | 3/1997 |
| WO | WO 9709843 | | 3/1997 |
| WO | WO 9709844 | | 3/1997 |
| WO | WO 9709845 | | 3/1997 |
| WO | WO 9709846 | | 3/1997 |
| WO | WO 9709848 | | 3/1997 |
| WO | WO 9709849 | | 3/1997 |
| WO | WO 9709852 | | 3/1997 |
| WO | WO 9709853 | | 3/1997 |
| WO | WO 9709854 | | 3/1997 |
| WO | WO 9709855 | | 3/1997 |
| WO | WO 9709856 | | 3/1997 |
| WO | WO 9709857 | | 3/1997 |
| WO | WO 9709858 | | 3/1997 |
| WO | WO 9709859 | | 3/1997 |
| WO | WO 9709861 | | 3/1997 |
| WO | WO 9709862 | | 3/1997 |
| WO | WO 9717818 | | 5/1997 |
| WO | WO 9717820 | | 5/1997 |
| WO | WO 9813942 | | 4/1998 |
| WO | WO 9816409 | | 4/1998 |
| WO | WO 9828942 | | 7/1998 |
| WO | WO 9831188 | | 7/1998 |
| WO | WO 9834320 | | 8/1998 |
| WO | WO 9839947 | | 9/1998 |
| WO | WO 9842536 | | 10/1998 |
| WO | WO 9843464 | | 10/1998 |
| WO | WO 9852381 | | 11/1998 |
| WO | WO 9852383 | | 11/1998 |
| WO | WO 9853638 | | 11/1998 |
| WO | WO 9902012 | | 1/1999 |
| WO | WO 9908479 | | 2/1999 |
| WO | WO 9911490 | | 3/1999 |
| WO | WO 9912387 | | 3/1999 |
| WO | WO 9913684 | | 3/1999 |
| WO | WO 9921397 | | 4/1999 |
| WO | WO 9935636 | | 7/1999 |
| WO | WO 9935883 | | 7/1999 |
| WO | WO 9937121 | | 7/1999 |
| WO | WO 9938155 | | 7/1999 |
| WO | WO 9941939 | | 8/1999 |
| WO | WO 9952322 | | 10/1999 |
| WO | WO 9952324 | | 10/1999 |
| WO | WO 9956497 | | 11/1999 |
| WO | WO 9962294 | | 12/1999 |
| WO | WO 9965274 | | 12/1999 |
| WO | WO 0001264 | | 1/2000 |
| WO | WO 0002417 | | 1/2000 |
| WO | WO 0007408 | | 2/2000 |
| WO | WO 0007409 | | 2/2000 |
| WO | WO 0013464 | | 3/2000 |
| WO | WO 0015003 | | 3/2000 |
| WO | WO 0033612 | | 6/2000 |
| WO | WO 0033613 | | 6/2000 |
| WO | WO 03104924 | | 12/2003 |
| WO | WO 2006020427 | | 2/2006 |
| WO | WO 2007092420 | | 8/2007 |
| WO | WO 2008067454 | | 6/2008 |
| WO | WO 2009070797 | | 6/2009 |
| WO | WO 2009114746 | | 9/2009 |
| WO | WO 2009155057 | | 12/2009 |
| WO | WO 2010027705 | | 3/2010 |
| WO | WO 2010051354 | | 5/2010 |
| WO | WO 2011081965 | | 7/2011 |
| WO | WO 2013055394 | | 4/2013 |
| WO | WO 2013076223 | | 5/2013 |
| WO | WO 2014201103 | | 12/2014 |
| WO | WO 2015061393 | | 4/2015 |
| WO | WO 2015077681 | | 5/2015 |
| WO | WO 2015161034 | | 10/2015 |
| WO | WO 2016019263 | | 2/2016 |
| WO | WO 2016022422 | | 2/2016 |
| WO | 2016144861 | A1 | 9/2016 |

OTHER PUBLICATIONS

Sepe, Michael. "Density & Molecular Weight in Polyethylene." Plastics Technology. Gardner Business Media, Inc., May 29, 2012. Web. <http://www.ptonline.com/columns/density-molecular-weight-in-polethylene>.

* cited by examiner

SYSTEM AND METHOD FOR STEREO FIELD ENHANCEMENT IN TWO-CHANNEL AUDIO SYSTEMS

CLAIM OF PRIORITY

The present application is a continuation-in-part application of previously filed application having Ser. No. 13/936,252, filed on Jul. 8, 2013 which claims priority to a provisional patent application having Ser. No. 61/834,063 and a filing date of Jun. 12, 2013, now abandoned, which are both incorporated herein by reference in their entireties.

BACKGROUND OF THE INVENTION

Stereophonic sound, or stereo, is a method of sound reproduction that creates the perception of directionality of sound. This is achieved by using two or more audio channels played through a configuration of two or more loudspeakers in order to create the impression that sound is coming from various directions. Today stereo sound is common in entertainment systems such as radio, TV, computers, and mobile devices.

In a two-channel audio system, an ideal stereo playback requires the careful placement of two loudspeakers in relations to the listener. The best results are obtained by using two identical speakers, in front of and equidistant from the listener, such that the listener and the two speakers form an equilateral triangle with equal angles of 60 degrees.

However, such a configuration is not always possible or desirable. For instance, many stereo speakers or systems comprise an all-in-one unit, such as a boombox, a sound bar, a cellphone, or speakers embedded into a computer or other device. Further, the configuration of a room may not make it possible for two speakers to be placed equidistantly from the listener. In these less-than-ideal situations, a stereo audio signal cannot be fully appreciated or perceived by the listener.

To compensate for these situations, a "stereo width" control may be implemented for a stereo audio system. A stereo width control allows the image width of a stereo signal to be increased or decreased using Mid/Side ("M/S") processing. As the width is adjusted, the central sounds remain in the center, and the edges are pulled either inwards or pushed outwards. Specifically, the stereo width of a speaker system can be increased by increasing the level of side signal relative to the middle signal, or decreased by decreasing the level of side signal relative to the middle signal.

However, current static stereo width adjustment methods are not ideal, because different audio signals have different amounts of side signal. As such, it would be beneficial to dynamically control the stereo width adjustment of side signal relative to the middle signal dynamically in order to create a consistent immersive experience in a stereo audio system.

FIELD OF THE INVENTION

The present invention provides for methods and systems for digitally processing a two-channel audio input signal for stereo field enhancement. Specifically, some embodiments relate to digitally processing the two-channel audio input signal in a manner such that immersive studio-quality sound can be reproduced for a listener in a two-channel audio system.

SUMMARY OF THE INVENTION

The present invention meets the existing needs described above by providing for a method and system for dynamically controlling the relationship between middle and side signals for purposes of stereo width adjustment, while preserving and at times enhancing the overall sound quality and volume of the original input signal.

Accordingly, in initially broad terms, a two-channel audio input signal may first be split into a low frequency signal and a higher frequency signal based on a first cutoff frequency. This allows phase relationships of the low frequency signal to be maintained. In most situations, the lower the frequency, the less easy it is to determine the point of origin of a sound. As such, low frequencies do not need to be adjusted for stereo-width as it makes sense to share the load of reproducing them through both speakers equally.

The higher frequency signal is then further split into a middle signal and a side signal. The middle signal being the sum of the right channel and left channel of the higher frequency signal. The side signal being the sum of the right channel and the inverse of the left channel of the higher frequency signal. The middle signal is processed and used as a detection signal in order to dynamically modulate the side signal, and thereby adjusting the stereo width of the higher frequency signal. In other words, the modified middle signal or detection signal determines how strongly the side signal is modulated. The resulting gain-modulated side signal leads to a more consistent and immersive experience of sound for the listener.

In at least one embodiment, the gain-modulated side signal is further adjusted by a makeup gain. The makeup gain ensures that the side signal is at a gain level equal to or above the original side signal. Further, the gain-modulation of the side signal may be subject to a gain reduction ceiling. This gain reduction ceiling may be tied to the makeup gain in at least one embodiment of the invention. This for example, ensures that if 8 dB of side boost is desired, then the decrease in gain during modulation will never be more than 8 dB. Thus, the original stereo effect is not lost.

The resulting gain-modulated side signal and the middle signal are then recombined. In some embodiments, the earlier low frequency signal is also recombined in this stage in order to create a final output signal. In other embodiments, the recombined and processed higher frequency signal with the gain-modulated side signal is further processed for a delay of high frequency signal relative to midrange frequency signal.

Accordingly, the processed higher frequency signal is transmitted to a second filter in at least one other embodiment. The second filter splits the processed higher frequency signal into a high frequency signal and a midrange frequency signal based on a second cutoff frequency. The high frequency signal is then sent through a delay module to delay either the right or left channel, or both right and left channels up to 999 samples. The delayed high frequency signal, midrange frequency signal, and low frequency signal are recombined in this embodiment in order to create a final output signal. The final output signal may be sent to an output device for playback or for additional processing including but not limited to dynamic range processing.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As illustrated by the accompanying drawings, the present invention is directed to a system and method for stereo field enhancement in two-channel audio systems.

Figure 1:
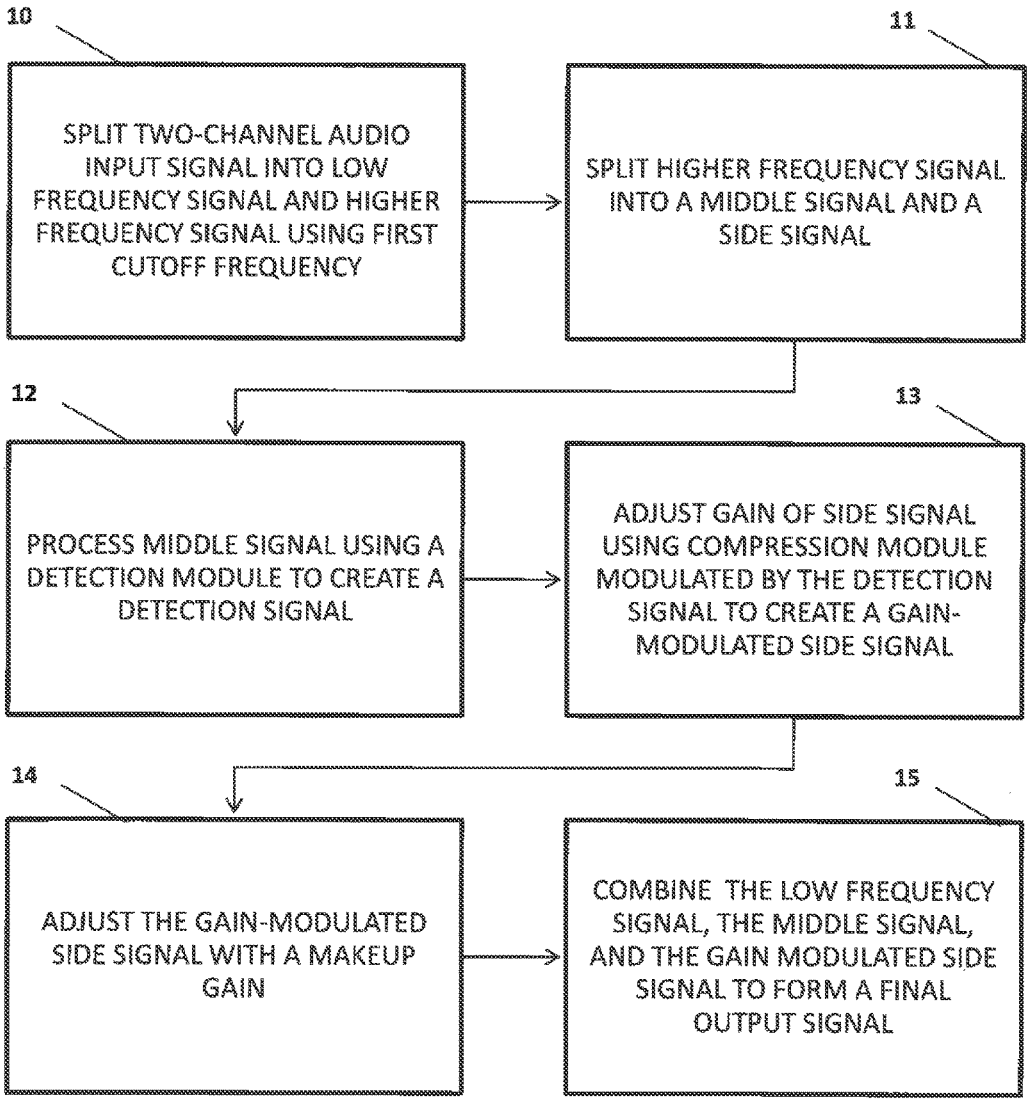
FIG. 1 shows a block diagram of one preferred embodiment of the stereo field enhancement method of the present invention.

As schematically represented, FIG. 1 illustrates the steps of at least one preferred embodiment of the present invention. In this embodiment, a two-channel audio input signal is first split, as in 10, into a low frequency signal and a higher frequency signal using a first cutoff frequency. The resulting low frequency signal comprises frequencies below the first cutoff frequency. Similarly, the resulting high frequency signal comprises those frequencies above the first cutoff frequency. In at least one embodiment, the first cutoff frequency is generally between 20 Hz and 1000 Hz. The first cutoff frequency may be further adjustable in at least one embodiment. The audio input signal is split, in at least one embodiment, by use of at least one electronic filter comprising circuits structured and configured to filter selected frequencies. The audio input signal may also be split by other appropriate circuits and/or circuit configurations.

The higher frequency signal is then further split, as in 11, into a middle signal and a side signal. The audio input signal and the resulting higher frequency signal comprises a right channel signal and a left channel signal. As such, the middle signal comprises the sum of the right channel signal and the left channel signal. In contrast, the side signal comprises the sum of the right channel signal and the inverse of the left channel signal, or in other words the left channel signal is subtracted from the right channel signal. The higher frequency signal is split into the middle signal and side signal by use of an M/S splitter circuit. Specifically, the M/S splitter circuit may comprise a sum and difference circuit to add the left and right signals to create the middle signal, and correspondingly subtract the left from the right channel to create the side signal. The higher frequency signal may also be split by other appropriate circuits and/or circuit configurations.

The middle signal is further processed, as in 12, through a detection module in order to create a detection signal. In at least one embodiment, the detection module comprises at least two shelving filters, for instance a low shelf and a high shelf filter. The detection signal is used to modulate the compression module, which adjusts, as in 13, the gain of the side signal in order to create a gain-modulated side signal. Further, the gain of the side signal may be limited to an adjustable gain reduction ceiling. The adjustable gain reduction ceiling may generally be between 0 dB and 12 dB. The gain-modulated side signal is further adjusted, as in 14, with a makeup gain. The adjustable gain reduction ceiling in 13 may be further set to correspond with the makeup gain as in 14. This preserves the output volume of the modulated side signal, by ensuring that the final output is equal to or above the original side signal. In at least one embodiment, the compression module comprises a dynamic range compression module. More specifically, the compression module may comprise an automatic gain controller. The compression module may further comprise other circuits and/or circuit configurations appropriate for the gain modulation as described.

The resulting low frequency signal in 10, the middle signal in 11, and the gain-modulated side signal adjusted with a makeup gain in 14, are all combined to form a final output signal, as in 15. This final output signal is the input signal with the side signal modulated dynamically based on the middle signal. In other words, the stereo width of the input signal is dynamically adjusted in the resulting output signal. The signals are combined in at least one embodiment, using an electronic mixer or other mixer. The mixer may be an electrical circuit that combines two or more electronic signals into a composite output signal.

Figure 2:
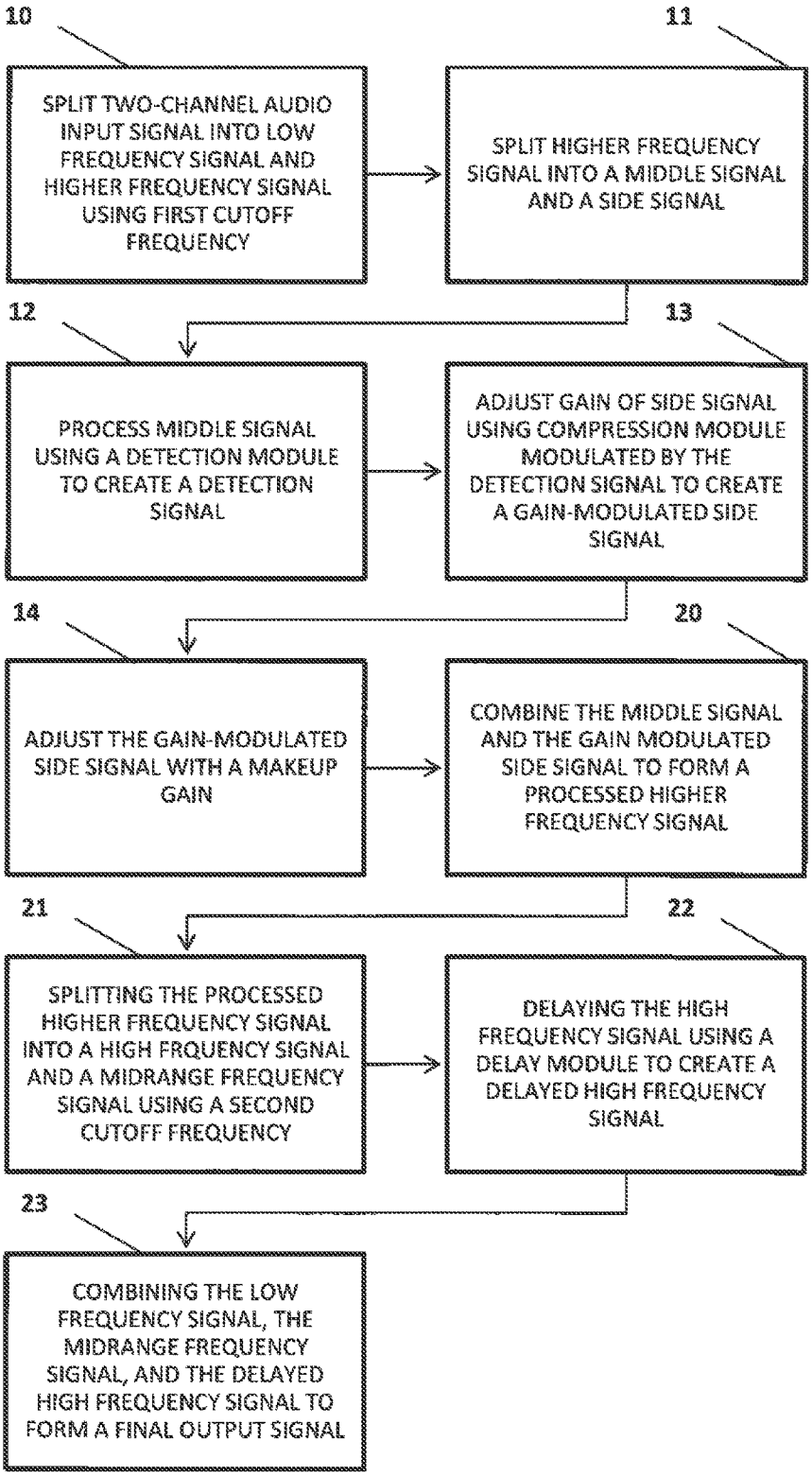
FIG. 2 shows a block diagram of another preferred embodiment of the stereo field enhancement method of the present invention, which further includes delaying high frequency signal.

As schematically represented, FIG. 2 illustrates additional steps of the present invention which are included in another preferred embodiment. Similar to the FIG. 1 embodiment, a two-channel audio input signal is first split into a low frequency signal and a higher frequency signal using a first cutoff frequency, as in 10. The higher frequency signal is then split into a middle signal and a side signal, as in 11. The middle signal is processed, as in 12, using a detection module to create a detection signal. The gain of the side signal is then modulated, as in 13, by the detection signal in a compression module, to create a gain-modulated side signal. The gain-modulated side signal is then adjusted, as in 14, with a makeup gain.

The middle signal and the gain modulated side signal are further combined in order to form a processed higher frequency signal, as in 20. The signals may be combined by a mixer or other electric circuit as aforementioned.

In certain applications it is further desirable to make adjustments to the stereo field by delaying high frequency information relative to midrange frequency. As such, the processed higher frequency signal is further split, as in 21, into a high frequency signal and a midrange frequency signal using a second cutoff frequency. The frequency above the second cutoff frequency are split into the high frequency signal, and the frequency below the second cutoff frequency are split into the midrange frequency signal. The second cutoff frequency may generally be between 1 kHz and 20 kHz. The second cutoff frequency may be adjustable in at least one embodiment of the present invention. The processed high frequency signal may be split by an electronic filter or other appropriate circuits and/or circuit configurations.

The resulting high frequency signal is delayed, as in 22, by use of a delay module to create a delayed high frequency signal. The delay interval may be between 1 and 999 samples in at least one embodiment of the present invention.

The delay may be adjustable. The delay module may further comprise left and/or right sub-modules which are capable of delaying the left and/or right high frequency channels selectively or collectively. In at least one embodiment, the delay module may comprise comb filters to delay the signal. In other embodiments, the delay module may comprise other circuits and/or circuit configurations appropriate for delaying an audio signal.

The resultant low frequency signal in 10, the midrange frequency signal in 21, and the delayed high frequency signal in 22, are all combined to form a final output signal, as in 23. The final output signal in this embodiment is the input signal with the side signal modulated dynamically based on the middle signal, and the high frequency portion of that processed signal further delayed relative to the midrange. The signals again are combined in a mixer in at least one embodiment. The signals may also be combined by any other circuits and/or circuit configurations appropriate for combining multiple audio signals.

Figure 3:
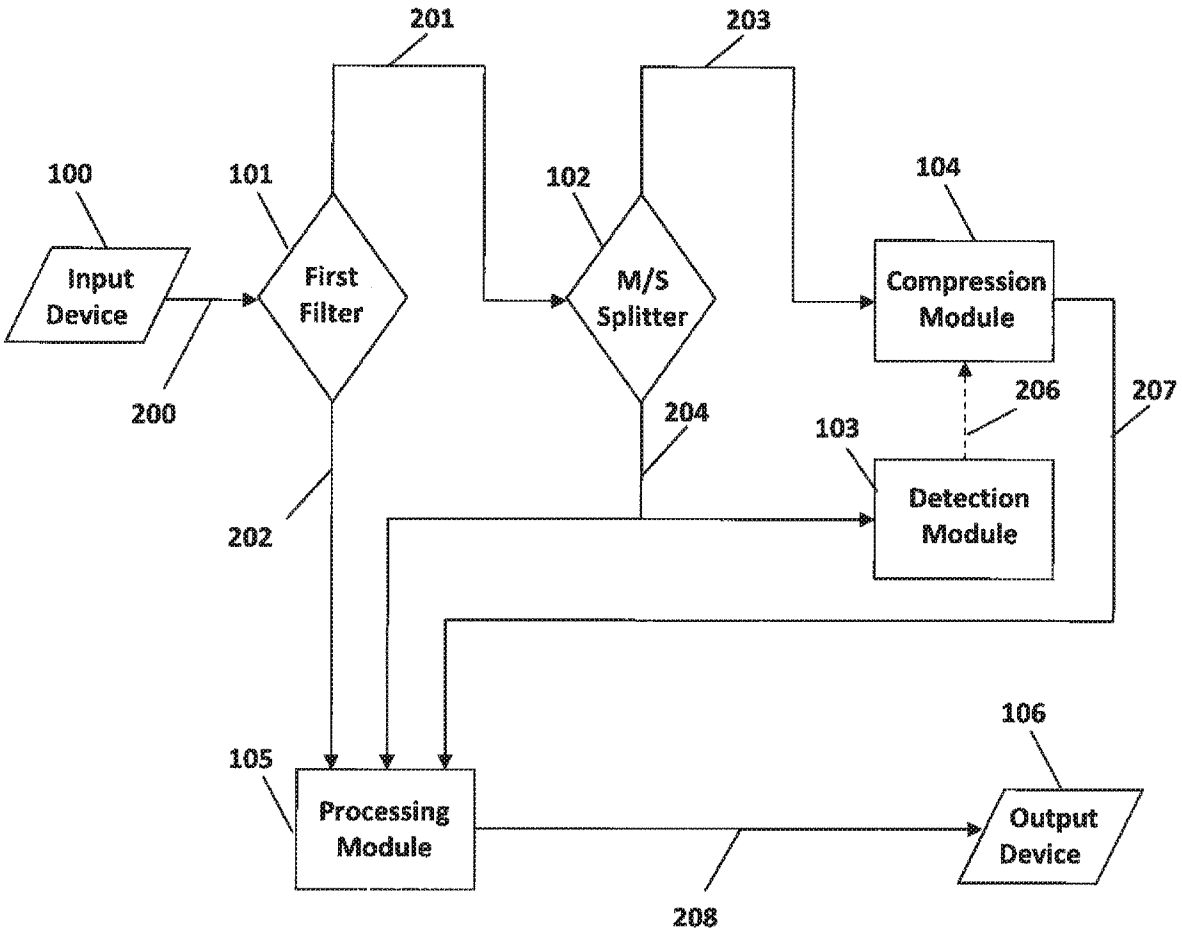
FIG. 3 shows a block diagram of yet another preferred embodiment of the stereo field enhancement system of the present invention.

As schematically represented, FIG. 3 illustrates the system of at least one preferred embodiment of the present invention. In this embodiment, the system generally comprises an input device 100, a first filter 101, an M/S splitter 102, a detection module 103, a compression module 104, a processing module 105, and an output device 106.

The input device 100 is at least partially structured and/or configured to transmit a two-channel audio input signal 200 into the first filter 101. The input device 100 may comprise at least portions of an audio device structured and configured for audio playback. The input device 100 may comprise a stereo system, a portable music player, a mobile device, a computer, a sound or audio card, and any other device or combination of electronic circuits that is suitable for audio playback.

The first filter 101 is structured to filter or split the two-channel audio input signal 200 to result in a higher frequency signal 201 and a low frequency signal 202, based on a first cutoff frequency. The higher frequency signal 201 is transmitted to an M/S splitter 102, while the lower frequency signal 202 is transmitted to a processing module 105. The higher frequency signal 201 comprises frequencies above the first cutoff frequency. Similarly, the lower frequency signal 202 comprises those frequencies below the first cutoff frequency. The first filter 101 may be further structured with a configurable or adjustable first cutoff frequency. In at least one embodiment, the first filter 101 may comprise an adjustable first cutoff frequency generally between 20 Hz and 1000 Hz. In other embodiments, the first filter 101 may comprise a static first cutoff frequency generally between 20 Hz and 1000 Hz. The first filter 101 may comprise electronic circuits or combinations of circuits structured to filter or split the two-channel audio input signal 200 into a higher frequency signal 201 and a low frequency signal 202. In at least one embodiment, the first filter 101 comprises a frequency bypass crossover employed to split low frequency signal 202 from higher frequency signal 201.

The M/S splitter 102 is structured to split the higher frequency signal 201 into a side signal 203 and a middle signal 204. The side signal 203 is transmitted to a compression module 104, while the middle signal 204 is transmitted to a processing module 105 as well as a detection module 103. The two-channel input audio signal 200 and resultant signals such as the higher frequency signal 201 comprise a left channel and a right channel. The middle signal 204 comprises the sum of the right channel signal and the left channel signal. The side signal 203 comprises the sum of the right channel signal and the inverse of the left channel signal. As such, the M/S splitter 102 comprises circuits and/or combinations of circuits structured to split the higher frequency signal 201 comprising a left channel and a right channel into a middle signal and a side signal. In at least one embodiment, the M/S splitter 102 comprises a sum and difference circuit. In other embodiments, the M/S splitter 102 may comprise adder and invert circuits.

The detection module 103 is structured to modify the middle signal 204 into a detection signal 206. The detection signal 206 is then transmitted to the compression module 104. In at least one embodiment, the detection module comprises at least two shelving filters. More particularly, in at least one embodiment, the detection module comprises a low shelf filter and a high shelf filter structured to create a 24 dB differential between high and low frequencies within the middle signal 204, in the creation of the detection signal 206.

The compression module 104 is structured to modulate the side signal 203 based on the detection signal 206 to create a gain-modulated side signal 207. In other words, the detection signal 206 determines how strongly the compression module 104 will modulate the side signal 207. In at least one embodiment, the compression module 104 is further configured with an adjustable gain reduction ceiling. As such, the gain reduction ceiling ensures that the side signal 207 is never reduced more than a predetermined dB level. In at least one embodiment, the gain reduction ceiling is generally between 0 dB and 12 dB. The compression module may further be configured with an adjustable gain reduction ceiling corresponding to a makeup gain configured in the processing module 105. In some embodiments, the gain reduction ceiling may be static. The compression module 104 may comprise any device or combination of circuits that is structured and configured for dynamic range compression.

The processing module 105 is configured to combine the low frequency signal 202, the middle signal 204, and the gain-modulated side signal 207 to form a final output signal 208. In at least one embodiment, and before combining the signals, the processing module 105 may be further configured to adjust the gain-modulated side signal 207 with a makeup gain. In other embodiments, the makeup gain is adjusted to the gain-modulated side signal 207 from within the compression module 104. In at least one embodiment, the compression module 104 has an adjustable gain reduction ceiling which corresponds to the makeup gain set or configured in the processing module 105. This ensures that the gain-modulated side signal 207 is at an output level equal to or above the original side signal 203. For example, if a 8 dB of side boost is set and configured, then the compression module 104 will never decrease the gain of the side signal 203 more than 8 dB. The processing module 105 may comprise circuits or combination of circuits, such as but not limited to a mixer, structured to combine the aforementioned signals. The processing module 105 may further comprise circuits or combination of circuits for adjusting signal 207 with a makeup gain.

Figure 5:
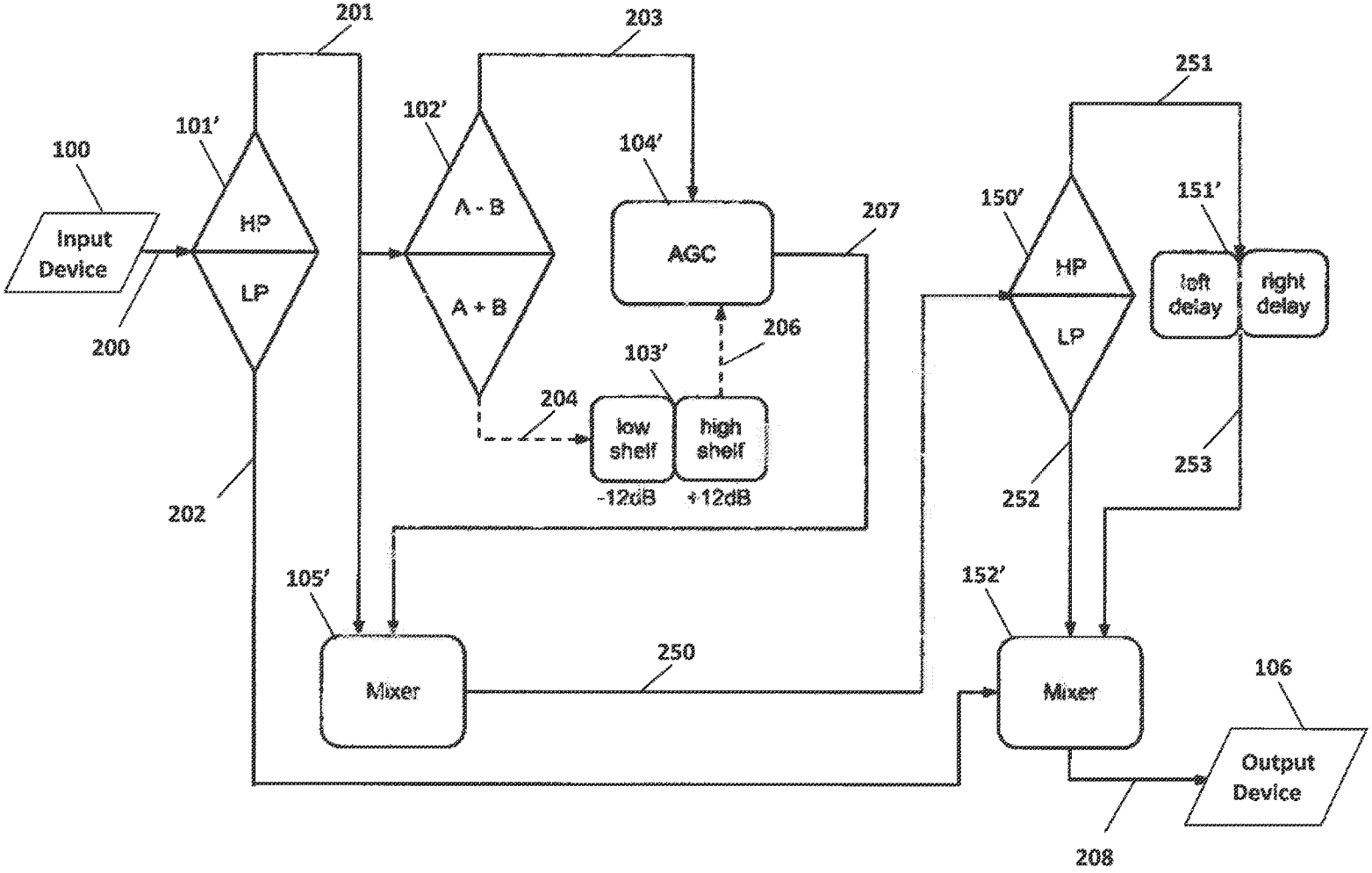
FIG. 5 shows a block diagram of yet another preferred embodiment of the stereo field enhancement system for the present invention using certain electronic circuits and components.

In at least one embodiment, rather than combining the middle signal from signal 204, the processing module 105 may recombine the middle signal or information directly from signal 201, as illustrated in FIG. 5, for purposes of forming the final output signal 208. As such, the processing module 105 may comprise alternative circuits or combinations of circuits appropriate for combining middle information from 201, low frequency signal 202, and the gain-modulated side signal 207 in order to form the final output signal 208.

The output device 106 may be structured to further process the final output signal 208. In at least one embodiment, the output device 106 may be equipped for dynamic range processing of the stereo field enhanced final output signal 208.

Figure 4:
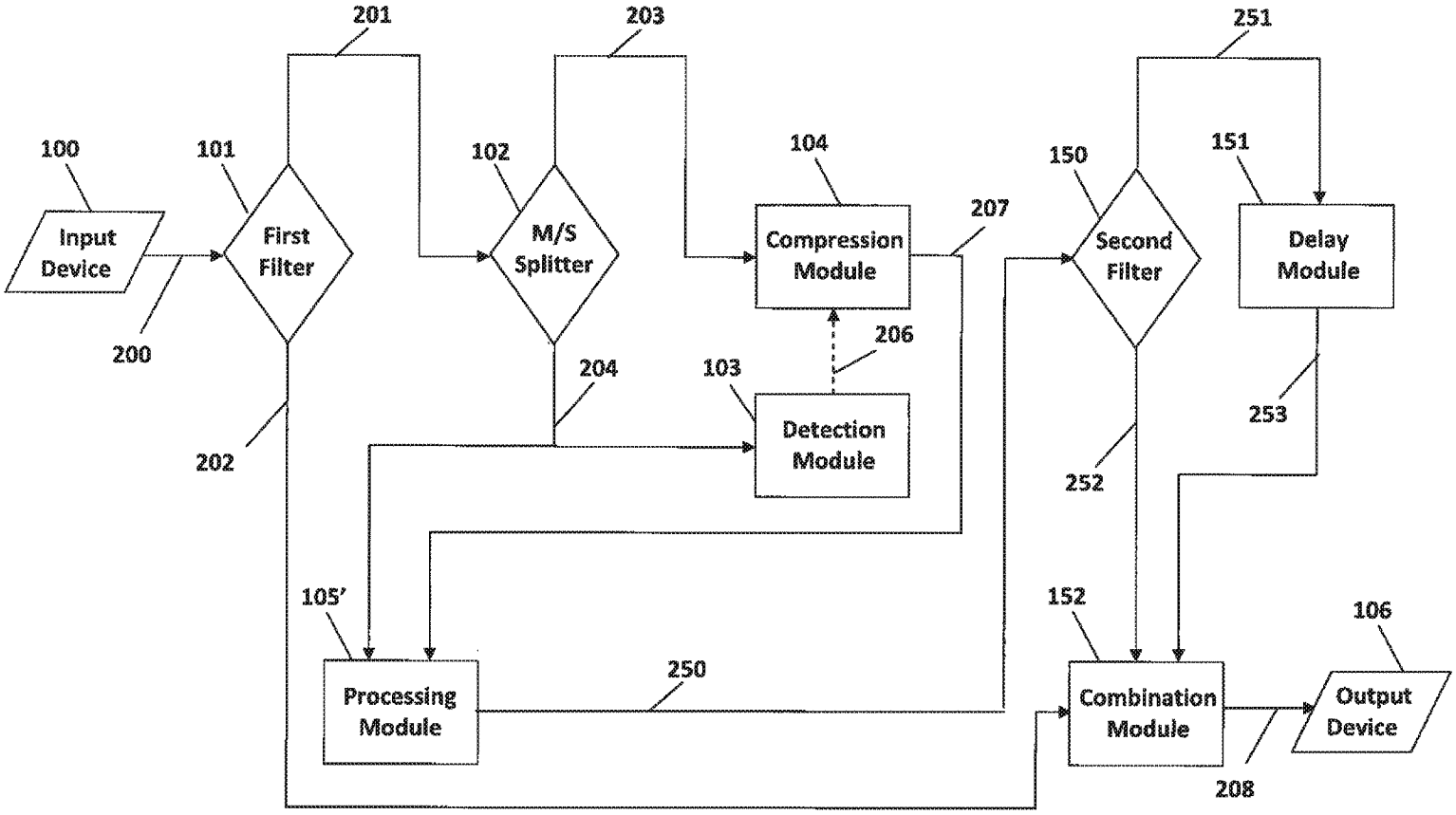
FIG. 4 shows a block diagram of yet another preferred embodiment of the stereo field enhancement system of the present invention, which further includes a delay module.

As schematically represented, FIG. 4 illustrates the system of an embodiment of the present invention further comprising a second filter 150, a delay module 151, and a combination module 152. These additional components facilitate the delaying of high frequency signal relative to midrange frequency signal, in applications where it is desirable to create such a delay.

In this embodiment, the system of the present invention similarly comprises an input device 100 structured and/or configured to transmit a two-channel audio input signal 200 into a first filter 101. The first filter 101 is structured to split the two-channel audio input signal 200 into a higher frequency signal 201 and a low frequency signal 202, based on a first cutoff frequency. The higher frequency signal 201 is transmitted to an M/S splitter 102; however, the lower frequency signal 202 is transmitted to a combination module 152. The M/S splitter 102 is structured to split higher frequency signal 201 into a side signal 203 and a middle signal 204. The side signal 203 is transmitted to a compression module 104, and the middle signal 204 is transmitted to a processing module 105. The detection module 103 is structured to modify the middle signal 204 into a detection signal 206, similar to the previous embodiment as in FIG. 3. The compression module 104 is similarly structured to modulate the side signal 203 based on the detection signal 206 to create a gain-modulated side signal 207.

The processing module 105 combines the middle signal 204 and the gain-modulated side signal 207 in order to form a processed higher frequency signal 250. The processed higher frequency signal 250 is then transmitted to a second filter 150. The processing module 105 may similarly be configured to adjust the gain-modulated side signal 207 with a makeup gain. In other embodiments, the makeup gain is adjusted to the gain-modulated side signal 207 from within the compression module 104. In at least one embodiment, the compression module 104 has an adjustable gain reduction ceiling which corresponds to the makeup gain set or configured in the processing module 105. This ensures the gain-modulated side signal 207 to be an output level equal to or above the original side signal 203. The processing module 105 may comprise circuits or combination of circuits, such as but not limited to a mixer, structured to combine middle signal 204 and gain-modulated side signal 207. The processing module 105 may further comprise circuits or combination of circuits for adjusting gain-modulated side signal 207 with a makeup gain.

In at least one embodiment, rather than combining the middle signal from signal 204, the processing module 105 may recombine the middle signal or information directly from signal 201, as illustrated in FIG. 5, for purposes of forming the processed higher frequency signal 250. As such, the processing module 105 may comprise alternative circuits or combinations of circuits appropriate for combining middle information from 201, and the gain-modulated side signal 207 in order to form the signal 250.

The second filter 150 is structured to filter or split the processed higher frequency signal 250 into a high frequency signal 251 and a middle frequency signal 252 using a second cutoff frequency. The high frequency signal 251 is transmitted to a delay module 151, while the midrange frequency signal 252 is transmitted to a combination module 152. The high frequency signal 251 comprises frequencies above the second cutoff frequency. Similarly, the midrange frequency signal 252 comprises those frequencies below the second cutoff frequency. The second filter 150 may be further structured with an adjustable or configurable second cutoff frequency. In at least one embodiment, the second filter 150 may comprise an adjustable second cutoff frequency generally between 1 kHz and 20 kHz. In other embodiments, the second filter 150 may comprise a static second cutoff frequency generally between 1 kHz and 20 kHz. The second filter 150 may comprise electronic circuits or combinations thereof structured to filter or spilt the processed higher frequency input signal 250 into a high frequency signal 251 and a midrange frequency signal 252. In at least one embodiment, the second filter 150 comprises a frequency bypass crossover employed to split midrange frequency signal 252 from high frequency signal 251.

The delay module 151 is structured and/or configured to delay the high frequency signal 251 in order to create a delayed high frequency signal 253. The delayed high frequency signal 253 is transmitted to the combination module 152. The delay module 151 may further be structured with an adjustable delay interval generally between 1 and 999 samples. In other embodiments, the delay module 151 may comprise a static delay interval generally between 1 and 999 samples. In at least one embodiment, the delay module 151 may selectively delay the left or right channels of the high frequency signal 253. The delay module 151 may also delay both the left and right channels of the high frequency signal 253. This allows the delay module 151 to create a comb filtering effect and acoustic phase decorrelation, which may be effective in creating a more immersive stereo field for the listener. The delay module 151 may comprise any circuit or combination of circuits structured and configured for creating a delayed signal. In at least one embodiment, the delay module 151 may comprise comb filters.

The combination module 152 is structured to combine the low frequency signal 202, the midrange frequency signal 252, and the delayed high frequency signal 253 in order to form a final output signal 208. The combination module 152 comprises circuits or combinations of circuits, such as but not limited to a mixer, structured to combine signals 202, 252, and 253. The final output signal 208 is transmitted to an output device 106, which may be structured to further process the final output signal 208. In at least one embodiment, the output device 106 may be structured and configured for dynamic range processing of the final output signal 208.

As illustrated in FIG. 5, the filters, splitters, modules, mixers, devices, and other components of the present invention may take on various embodiments. The present invention may include, but are not limited to these variations.

The input device 100 may comprise any device capable of creating a two-channel audio input signal 200 which includes a right channel and a left channel. The input device 100 may comprise a stereo system such as a home entertainment system, a portable music player such as a MP3 player, a radio or device capable of receiving radio signals such as a FM, AM, or XM receiver, a computer which may include a sound or audio card, or a mobile device such as a phone or tablet.

The first filter 101 may comprise any circuits or combinations of circuits capable of splitting frequency signals based on a first cutoff frequency. In at least one embodiment, the first filter 101 comprises an audio crossover 101', such that low frequencies, or those below the first cutoff frequency, are passed through the crossover as 202. On the other hand, higher frequencies above the first cutoff frequency are directed as 201 for further processing. The second filter 150 may employ similar circuits capable of splitting frequency signals based on a second cutoff frequency, such as an audio crossover.

The M/S splitter 102 is structured to split a stereo signal comprising a left channel and a right channel into a middle signal and a side signal. The middle signal is created by adding the right and left channels together. The side signal is created by inverting the left channel then adding the inverted left channel to the right channel. As such, at least one embodiment of the M/S splitter 102 comprises a sum and difference circuit 102'. In at least one embodiment, the sum and difference 102' may comprise adders and inverters structured to create a middle and a side signal from a two-channel audio signal.

Detection module 103 and signals 204 and 206 form a sidechain path in at least one embodiment of the present invention. In at least one embodiment, the detection module 103 comprises a low shelf filter and a high shelf filter 103', which together create a 24 dB differential between high and low frequencies in the middle signal 204 in order to create a detection signal 206. The compression module 104 uses the detection signal 206 to modulate the gain of the incoming side signal 203. In at least one embodiment, the compression module 104 comprises an automatic gain controller 104' ("AGC"). The AGC 104' may comprise standard dynamic range compression controls such as threshold, ratio, attack and release. Threshold allows the AGC 104' to reduce the level of the side signal 203 if its amplitude exceeds a certain threshold. Ratio allows the AGC 104' to reduce the gain as determined by a ratio. Attack and release determines how quickly the AGC 104' acts. The attack phase is the period when the AGC 104' is decreasing gain to reach the level that is determined by the threshold. The release phase is the period that the AGC 104' is increasing gain to the level determined by the ratio. The AGC 104' may also feature soft and hard knees to control the bend in the response curve of the output or gain-modulated side signal 207, and other dynamic range compression controls. In some embodiments, a makeup gain is added to the gain-modulated side signal 207 within the AGC 104'. Further, the AGC 104' may comprise a gain reduction ceiling that corresponds to the makeup gain. In at least one embodiment, the gain reduction ceiling may vary from 0 dB to 12 dB. The compression module 104 may also comprise other gain reduction devices or compressors.

Processing module 105 is structured to combine the gain modulated side signal 207 with the middle information from the earlier signal 201. Alternatively, the processor module 105 may also recombine the gain modulated side signal 207 with the middle signal as from 204. Regardless of the different circuit pathways, the processing module 105 is structured to recombine signal or information that was earlier split by the first filter 101 and the M/S splitter 102. As such, the processing module 105 may comprise a mixer 105' in at least one embodiment of the present invention. The mixer 105' may be an electronic mixer structured to combine two or more signals into a composite signal. Similarly, combination module 152 may also comprise a similar mixer 152' that may be an electronic mixer structured to combine two or more signals.

Delay module 151 is structured to delay a high frequency signal 251. The delay module may selectively delay the left channel and/or the right channel of signal 251. As such, the delay module 151 may comprise left and right delay circuits 151'. The circuits 151' may comprise components structured to cause a delay of the signal. The delay may be adjustable from 1 to 999 samples or may be fixed. The delay circuits 151' may comprise digital and/or analog systems, for example, including but not limited to digital signal processors that record the signal into a storage buffer, and then play back the stored audio based on timing parameters preferably ranging from 1 to 999 samples.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A method for stereo field enhancement in two-channel audio systems, comprising:

splitting a two-channel audio input signal into a low frequency signal and a higher frequency signal using a first cutoff frequency, splitting the higher frequency signal into a middle signal and a side signal, processing the middle signal using a detection module to create a detection signal, dynamically adjusting the gain on the side signal using the detection signal to create a gain-modulated side signal, and adjusting the gain-modulated side signal to a point at least equal to the side signal.

2. The method as recited in claim 1 further comprising combining the low frequency signal, the middle signal, and the gain-modulated side signal to form a final output signal.

3. The method as recited in claim 1 further comprising combining the middle signal and the gain-modulated side signal to form a processed higher frequency signal.

4. The method as recited in claim 3 further comprising splitting the processed higher frequency signal into a high frequency signal and a midrange frequency signal using a second cutoff frequency.

5. The method as recited in claim 4 further comprising delaying the high frequency signal using a delay module to create a delayed high frequency signal.

6. The method as recited in claim 5 further comprising combining the low frequency signal, the midrange frequency signal, and the delayed high frequency signal to form a final output signal.

7. The method as recited in claim 4 wherein the second cutoff frequency is selected from the range between 1 kHz and 20 kHz.

8. The method as recited in claim 5 wherein the delay module delays the high frequency signal with a delay interval selected from the range between 1 and 999 samples.

9. The method as recited in claim 1 wherein the first cutoff frequency is selected from the range between 20 Hz and 1000 Hz.

10. The method as recited in claim 1 defining the two-channel audio input signal to comprise a right channel signal and a left channel signal.

11. The method as recited in claim 10 defining the middle signal to comprise the sum of the right channel signal and the left channel signal.

12. The method as recited in claim 10 defining the side signal to comprise the sum of the right channel signal and the inverse of the left channel signal.

13. The method as recited in claim 1 wherein the detection module comprises at least two shelving filters structured to create a 24 dB differential between high and low frequencies in the middle signal.

14. The method as recited in claim 1 wherein the step of adjusting the gain on the side signal further comprises adjusting the gain using a compression module limited to an adjustable gain reduction ceiling.

15. The method as recited in claim 14 wherein the compression module comprises an adjustable gain reduction ceiling selected from the range between 0 dB and 12 dB.

16. The method as recited in claim 14 wherein the compression module comprises an adjustable gain reduction ceiling corresponding to the makeup gain.

17. A system for stereo field enhancement in two-channel audio systems, comprising:

a two-channel audio input signal, a first filter structured to split said two-channel audio input signal into at least a low frequency signal and a higher frequency signal based on a first cutoff frequency, a splitter structured to split said higher frequency signal into a middle signal and a side signal, a detection module configured to create a detection signal from said middle signal, a compression module configured to modulate said side signal based on said detection signal in order to create a gain-modulated side signal, and a processing module configured to combine said low frequency signal, middle signal, and said gain-modulated side signal to form a final output signal.

18. The system as recited in claim 17 wherein said first filter is further structured with a first cutoff frequency selected from the range between 20 Hz and 1000 Hz.

19. The system as recited in claim 17 wherein said two-channel audio input signal comprises a right channel signal and a left channel signal.

20. The system as recited in claim 17 wherein said detection module comprises at least two shelving filters.

21. The system as recited in claim 17 wherein said compression module is further configured with an adjustable gain reduction ceiling selected from the range between 0 dB and 12 dB.

22. The system as recited in claim 17 wherein said processing module is further configured to adjust said gain-modulated side signal with a makeup gain.

23. The system as recited in claim 22 wherein said compression module is further configured with an adjustable gain reduction ceiling corresponding to said makeup gain of said processing module.

24. A system for stereo field enhancement in multi-channel audio systems, comprising:

an audio input signal, a first filter structured to split said audio input signal into a low frequency signal and a higher frequency signal based on a first cutoff frequency, a M/S splitter structured to split said higher frequency signal into a middle signal and a side signal, a detection module configured to create a detection signal from said middle signal, a compression module configured to dynamically modulate said side signal based on said detection signal in order to create a gain-modulated side signal, a processing module configured to combine said middle signal and said gain-modulated side signal to form a processed higher frequency signal, a second filter structured to split the processed higher frequency signal into a high frequency signal and a midrange frequency signal using a second cutoff frequency, and a combination module structured to combine said low frequency signal, said midrange frequency signal, and said high frequency signal to form a final output signal.

25. The system as recited in claim 24 wherein said first cutoff frequency is selected from the range between 20 Hz and 1000 Hz.

26. The system as recited in claim 24 wherein said second cutoff is selected from the range between 1 kHz and 20 kHz.

27. The system as recited in claim 24 further comprising a delay module configured to delay said high frequency signal with a delay interval selected from the range between 1 and 999 samples.

28. The system as recited in claim 24 wherein said compression module is further configured with an adjustable gain reduction ceiling selected from the range between 0 dB and 12 dB.

* * * * *